US005379605A

United States Patent [19]

Outlaw et al.

[11] Patent Number: 5,379,605

[45] Date of Patent: Jan. 10, 1995

[54] METHOD FOR CLEANING AIR CONDITIONING SYSTEM

[75] Inventors: George R. Outlaw, Arlington; Fred L. Ptacek, Joshua; Charles R. Smith, Grapevine, all of Tex.

[73] Assignee: Wynn's Climate Systems, Inc., Fort Worth, Tex.

[21] Appl. No.: 187,212

[22] Filed: Jan. 27, 1994

[51] Int. Cl.[6] ..... F25B 45/00

[52] U.S. Cl. ..... 62/77; 62/292; 62/303

[58] Field of Search ..... 62/77, 85, 149, 292, 62/475, 303

[56] References Cited

U.S. PATENT DOCUMENTS 4,261,178 4/1981 Cain .
4,364,236 12/1982 Lower et al. .
4,441,330 4/1984 Lower et al. .
4,537,660 8/1985 McCord .
5,094,087 3/1992 Gramkow .
5,117,641 6/1992 Keltner .
5,168,720 12/1992 Keltner .
5,181,391 1/1993 Manz .
5,218,831 6/1993 Keltner .
5,231,843 8/1993 Keltner .
5,247,803 9/1993 Adams et al. .
5,247,812 9/1993 Keltner .

*Primary Examiner*—John M. Sollecito
*Attorney, Agent, or Firm*—James E. Bradley

[57] ABSTRACT

A method of cleaning an air conditioning system utilizes a maintenance unit. The maintenance unit has a recovery compressor, recovery condenser, a recovery evaporator, and recovery expansion valve. Operating the recovery compressor draws refrigerant from the air conditioning system, filters it, and passes it into a storage container. To clean, a control valve leading from the storage container is opened to flow refrigerant from the storage container into both the high pressure and low pressure sides of the air conditioning system compressor. The recovery compressor continues to operate to apply a pressure to the air conditioning system up to a maximum level. Once this is reached, or a selected time interval elapses, the pressure in the air conditioning system is again reduced and brought to a vacuum, causing refrigerant to flow back out of the air conditioning system, bringing with it foreign matter.

14 Claims, 1 Drawing Sheet

METHOD FOR CLEANING AIR CONDITIONING SYSTEM

BACKGROUND OF THE INVENTION

1. Field of the Invention

This invention relates in general to recovery units for recovering refrigerant from air conditioning systems, and in particular to a method for cleaning the air conditioning system of foreign matter.

2. Description of the Prior Art

Recovery units are used to recover refrigerant from air conditioning systems that require maintenance. A typical recovery unit has a compressor, condenser, evaporator, oil separator, and at least one filter. Hoses connect the air conditioning system to the recovery unit, with one hose connected to the suction side of the air conditioning system compressor, and the other hose connected to the high pressure or output side of the air conditioning compressor.

When operating, the recovery unit compressor draws refrigerant through the hoses, through the recovery unit expansion valve, evaporator, oil separator, filter and into the recovery unit compressor. The recovery unit compressor passes the high pressure, hot gas to the recovery unit condenser, which condenses the recovered refrigerant into a liquid, which then flows into a storage container. The filter in the recovery unit cleans the refrigerant as it passes through the recovery unit to the storage container.

The air conditioning system will often have foreign matter or debris contained within it due to its prior operation or due to a malfunction. It is desirable to clean the air conditioning system of the foreign matter as much as possible before recharging the air conditioning system.

Many maintenance workers disconnect the various components of the air conditioning system and discharge cleaning fluids through the various components individually in an effort to clean the components. While workable, this approach is time consuming.

Another prior art technique for cleaning a system is to provide the recovery unit with a liquid pump. The liquid pump supplies refrigerant liquid from the storage container to the air conditioning system. A hose connects the air conditioning system back to the recovery unit, so that the refrigerant will circulate through the air conditioning system. The flow rate provided by the liquid pump is preferably high enough to collect debris and purge the system, with the collected debris being trapped by the filters in the recovery unit. This technique requires an additional component, a liquid pump, along with associated valves and piping. Also, the liquid being pumped by the liquid pump through the conditioning system expands in the air conditioning system expansion valve into a gas, and consequently loses some of its ability to carry debris along with it.

SUMMARY OF THE INVENTION

The maintenance unit of this invention has a flush mode. In the flush mode, an outlet line from the storage container is communicated to both the suction side and the high pressure hoses. The operator operates the maintenance unit compressor and opens a control valve, allowing refrigerant to flow from the storage container into both the high and low pressure sides of the air conditioning system. The refrigerant flowing from the storage container into the air conditioning system will mostly be in a liquid state. The maintenance unit compressor continues this process until a selected maximum pressure in the air conditioning system is reached, or for a selected time interval, whichever occurs first. There will be no circulating flow through the air conditioning system at this point, rather the refrigerant flows only into the system and remains substantially liquid.

Then, once the selected time interval or maximum pressure is reached, whichever occurs first, the control board closes the control valve. The maintenance unit compressor continues to operate, now operating as a suction to remove refrigerant from the air conditioning system. The release of pressure on the air conditioning system causes refrigerant to rapidly flow back from the air conditioning system into the maintenance unit, mostly in the liquid state. The maintenance unit operates conventionally at that point to filter and process the refrigerant returning from the air conditioning system. The rapid flow from high pressure back to the low pressure on the suction side of the maintenance unit compressor causes the refrigerant to bring debris along with it. The maintenance unit may be cycled between flush and recover operations repeatedly to clean the air conditioning system of foreign matter.

DETAILED DESCRIPTION OF THE INVENTION

Figure 1:
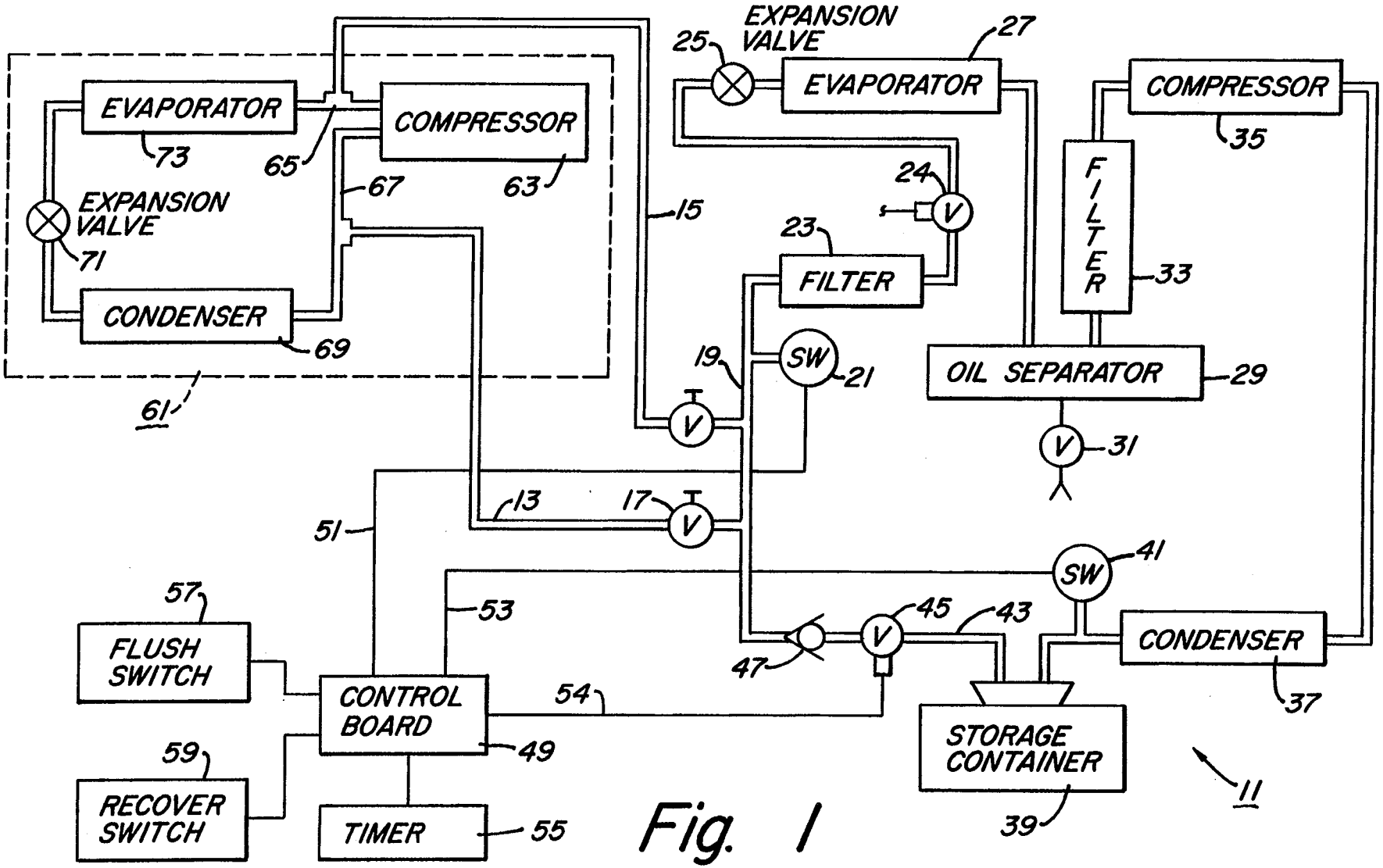
FIG. 1 is the sole figure and it is a schematic of a maintenance unit constructed in accordance with this invention and shown connected to an air conditioning system.

Maintenance unit 11 has a conventional high side hose 13 and a low side hose 15. Hoses 13 and 15 each have a manual valve 17 which is mounted to a manifold (not shown). The manifold leads to a single intake conduit 19 of maintenance unit 11. A low pressure switch 21 in intake conduit 19 provides a pressure indication when the pressure in intake conduit 19 reaches a selected minimum vacuum. A screen filter 23 connects into intake conduit 19 for filtering large particles of debris from the recovered refrigerant. Filter 23 connects to an expansion valve 25, which will expand liquid components of the recovered refrigerant into a gas. A solenoid actuated control valve 24 is located between filter 23 and expansion valve 25 for selectively opening and closing intake conduit 19.

An evaporator 27 connects to expansion valve 25. Evaporator 27 is a heat exchanger used to add heat to the cold gaseous refrigerant. Evaporator 27 connects to an oil separator 29, which is a type of accumulator. Oil separator 29 is a container which traps oil collected from the recovered refrigerant. A drain 31 is used to drain the recovered oil, which is measured and replaced.

Oil separator 29 connects to a filter and dryer 33 which will separate debris and other foreign matter such as water in the recovered refrigerant. Filter 33 connects to the suction side of a recovery compressor 35, which will compress the gaseous refrigerant to a high pressure.

Compressor 35 has an output side leading to a condenser 37, which will condense the high pressure, hot gaseous refrigerant into a warm liquid refrigerant. Condenser 37 connects to a storage container 39 for storing the recovered refrigerant under pressure. A high pressure switch 41 senses the pressure at the output side of condenser 37 and will provide a signal when the pressure reaches a selected maximum.

An outlet conduit 43 leads from near the bottom of storage container 39 to flow liquid refrigerant from storage container 39. A solenoid actuated control valve 45 connects into outlet conduit 43 for selectively opening and closing outlet conduit 43. A check valve 47 connects outlet conduit 43 to intake conduit 19 and prevents any reverse flow of refrigerant into outlet conduit 43 and back into storage container 39.

Maintenance unit 11 also has electrical controls associated with it, some of which are illustrated schematically in FIG. 1. The electrical controls include a control board 49 which will control power to recovery compressor 35 through an electrical line (not shown). Control board 49 has a sensor electrical line 51 leading from low pressure switch 21. Sensor line 51 supplies information to the control board 49 indicating when a sufficiently low vacuum has been reached in intake conduit 19. Similarly, a sensor electrical line 53 connects high pressure switch 41 to control board 49 to provide an indication when a selected high pressure has been reached at the intake conduit of storage container 39. An electrical line 54 connects control board 49 to solenoid control valve 45 for actuating control valve 45. Another electrical line (not shown) connects control board 49 to solenoid valve 24. A timer 55 connects to control board 49, serving as a clock. Control board 49 has a flush control switch 57 and a recover switch 59, both of which are manually actuable select switches.

An air conditioning system 61 is shown enclosed by the dotted lines and connected to maintenance unit 11. Air conditioning system 61 has a compressor 63 which has a suction side 65 and an output side 67. Compressor output side 67 leads to a condenser 69. Condenser 69 is connected to an expansion valve 71, which in turn leads to an evaporator 73. Evaporator 73 is connected to the suction side 65 of compressor 63.

In operation, the operator will first connect hose 13 to the high pressure side 67 of system compressor 63. The operator connects hose 15 to the low pressure side 65 of compressor 63. These connections are made through quick release connections that exist on air conditioning system 61 and hoses 13, 15. The operator opens valves 17 and depresses recover switch 59.

Control board 49 will open solenoid valve 24 and energize compressor 35. Solenoid valve 45 remains closed. Refrigerant from air conditioning system 61 will flow through hoses 13, 15 and into intake conduit 19. Usually the refrigerant will be a mixture of liquid and gas. Filter 23 will filter some of the larger particles and debris from the refrigerant being recovered. Expansion valve 25 will expand refrigerant still in a liquid state into a gaseous state. Evaporator 27 adds heat conventionally from the recovered refrigerant. Oil separator 29 will collect droplets of oil from the refrigerant as it passes through oil separator 29. Filter and dryer 33 will remove moisture from the refrigerant prior to entering recovery compressor 35. Compressor 35 compresses the recovered refrigerant, which flows through condenser 37 and condenses to a liquid. The clean liquid refrigerant passes into storage container 39. This procedure continues until all of the refrigerant has been recovered. Low pressure switch 21 will signal control board 49 when a selected minimum vacuum has been reached, such as five inches of mercury. At that point, control board 49 will signal compressor 35 to cease operating and will close solenoid valve 24. The liquid refrigerant in the storage container 39 will be under pressure.

If the operator then wishes to flush the air conditioning system of debris, he depresses flush switch 57. Control board 49 will open solenoid valve 24, open solenoid valve 45 and energize compressor 35. Liquid refrigerant will flow from storage container 39 due to the pressure in storage container 39. Compressor 35 continues to supply refrigerant to the storage container 39, preventing the pressure in storage container 39 from dropping significantly due to the outflow. The liquid refrigerant flows through check valve 47 and through both hoses 13 and 15 into the air conditioning system 61. Some of the refrigerant will flow back through filter 23, expansion valve 25, evaporator 27, oil separator 29, and filter 33 to the suction side of recovery compressor 35 so that compressor 35 can continue to supply refrigerant to storage container 39.

Note that there will not be any circulation through air conditioning system 61, as the refrigerant is flowing only into the system, and not through the system 61. The air conditioning system 61 will not be operating during this procedure. The refrigerant flowing into air conditioning system 61 will be mostly in a liquid state. The refrigerant flows in a conventional direction through system condenser 61 and in a reverse direction through system evaporator 73, with the separate flows meeting approximately at the system expansion valve 71. Some of the refrigerant will also flow into system compressor 63.

Compressor 35 continues to operate in this manner until either a selected time interval lapses or a maximum pressure in air conditioning system 61 is reached, whichever occurs first. The time interval will be signaled by timer 55 and would typically be about 10 minutes. The maximum pressure, typically 125 PSI, may occur before timer 55 reaches the selected elapsed time. If so, high pressure switch 41 will signal control board 49 that the high pressure at the outlet of condenser 39 has been reached. Air conditioning system 61 will be under the substantially the same pressure that exists at high pressure switch 41.

Control board 49 at that point will automatically switch to the recover mode. Compressor 35 continues to operate without stopping, and solenoid valve 24 remains open. Control board 49 closes control valve 45 to stop the outward flow from storage container 39. The output of recovery compressor 35 now flows only into storage container 39. Closing control valve 45 and leaving compressor 35 running and control valve 45 open causes a rapid pressure drop in air conditioning system 61. The refrigerant in air conditioning system 61 rapidly flows back out both hoses 13, 15, mostly as a liquid, and through evaporator 27 and filter 33 in the manner previously described. The rapid outward flow into maintenance unit 11 causes the recovered refrigerant to bring with it debris and foreign matter from air conditioning system 61. This foreign matter is collected by filters 23 and 33.

Compressor 35 will continue to operate until pressure switch 21 indicates that the minimum vacuum has been reached. At that point, control board 49 will then automatically switch again to the flush mode. The flush cycle is repeated, with control valve 45 being opened to allow flow of refrigerant from storage container 39 into hoses 13 and 15. This cycle is repeated as often as the operator wishes, with each cycle cleaning more of the foreign matter and debris from the air conditioning system 61. The operator can stop the cycle between flush and recover modes by pushing the recover switch 59, which will recover refrigerant to a minimum pressure, shut off recovery compressor 35 and close solenoid valve 24. The air conditioning system 61 may then be repaired. Or, if it has already been repaired, conventional procedures to recharge the system with refrigerant and lubricant will be employed.

The invention has significant advantages. The air conditioning system may be cleaned without the need for disconnecting its various components. A liquid pump is not required, as the refrigerant is not cycled through the system. Repeatedly pressurizing and reducing the pressure in the system will draw much of the foreign matter from the air conditioning system. The method requires little modification to existing maintenance units.

While the invention has been shown in only one of its forms, it should be apparent to those skilled in the art that it is not so limited, but is susceptible to various changes without departing from the scope of the invention.

We claim:

1. A method of cleaning an air conditioning system having a system compressor with an output side and a suction side, the method comprising:

providing a maintenance unit with a recovery expansion valve connected to a recovery evaporator, which leads to a suction side of a recovery compressor, the recovery compressor having an output side connected to a recovery condenser which leads to a storage container which has an outlet conduit and which contains refrigerant, the maintenance unit having at least one filter;

connecting the suction side and the output side of the system compressor to the recovery expansion valve; then communicating the outlet conduit of the storage container to the suction side and to the output side of the system compressor to flow refrigerant from the storage container into the air conditioning system simultaneously on both the suction side and the output side of the system compressor, while operating the recovery compressor to flow refrigerant into the storage container; then stopping the communication of the outlet conduit of the storage container to the suction side and to the output side of the system compressor; and operating the recovery compressor to recover refrigerant from the suction side and the output side of the system compressor and to flow the recovered refrigerant through the recovery expansion valve, recovery evaporator, filter, recovery condenser and into the storage container, the recovered refrigerant bringing along with it foreign matter from the air conditioning system which is filtered by the filter.

2. The method according to claim 1, wherein the step of flowing refrigerant from the storage container into the air conditioning system continues until the pressure of the refrigerant in the air conditioning system reaches a selected maximum level or a preselected time interval elapses, whichever occurs first.

3. The method according to claim 1, wherein the step of communicating the outlet conduit of the storage container to the suction side and to the output side of the system compressor comprises opening a valve in the outlet conduit.

4. The method according to claim 1, wherein the step of operating the recovery compressor to recover refrigerant from the suction side and the output side of the system compressor continues until a selected minimum pressure is reached.

5. The method according to claim 1 wherein the recovery expansion valve remains in communication with the suction and output sides of the system compressor while the refrigerant is flowing from the storage container to the suction and output sides of the system compressor, allowing some of the refrigerant flowing from the storage container to flow through the recovery expansion valve and recovery evaporator to the suction side of the recovery compressor, so that the recovery compressor can continue to flow refrigerant through the recovery condenser back into the storage container.

6. The method according to claim 1 wherein the step of stopping the communication of the outlet conduit of the storage container to the suction side and to the output side of the system compressor comprises closing a valve provided in the outlet conduit.

7. A method of cleaning an air conditioning system with a maintenance unit, the air conditioning system having a system compressor with an output side and a suction side, the maintenance unit having a recovery expansion valve connected to a recovery evaporator, which leads to a suction side of a recovery compressor, the recovery compressor having an output side connected to a recovery condenser which leads to a storage container which has an outlet conduit, the maintenance unit having at least one filter, the method comprising:

(a) connecting the suction side and the output side of the system compressor to the recovery expansion valve; then (b) communicating the outlet conduit of the storage container to the suction side and to the output side of the system compressor while the suction side and the output side of the system compressor remain in communication with the recovery expansion valve; and (c) operating the recovery compressor to supply refrigerant from the storage container through the outlet conduit and into the air conditioning system simultaneously on both the suction side and the output side of the system compressor, with some of the refrigerant flowing from the storage container flowing through the recovery expansion valve, recovery evaporator and into the suction side of the recovery compressor to enable the recovery compressor to replenish the storage container as refrigerant flows from the storage container into the air conditioning system; then (d) stopping the communication of the outlet conduit of the storage container to the suction side and to the output side of the system compressor; and (e) operating the recovery compressor to recover refrigerant from the suction side and the output side of the system compressor and to pass the recovered refrigerant through the recovery expansion valve, recovery evaporator, filter, recovery condenser and into the storage container, the recovered refrigerant bringing along with it foreign matter from the air conditioning system which is filtered by the filter.

8. The method according to claim 7, wherein step (c) continues until the first occurrence of the pressure of the refrigerant in the air conditioning system reaching a selected maximum level and a preselected time interval elapsing.

9. The method according to claim 7, wherein step (b) comprises opening a valve provided in the outlet conduit.

10. The method according to claim 7, wherein step (e) continues until a selected minimum pressure is reached.

11. The method according to claim 7 wherein step (d) comprises closing a valve provided in the outlet conduit.

12. The method according to claim 7 wherein the recovery compressor continuously operates without interruption through steps (b) through (e).

13. The method according to claim 7 wherein after completing step (e), steps (b) through (e) are repeated.

14. A method of cleaning an air conditioning system with a maintenance unit, the air conditioning system having a system compressor which supplies pressurized gaseous refrigerant from an output side to a system condenser, which condenses the refrigerant to a liquid, a system expansion valve which receives the liquid from the system condenser and expands it to a cold gas which passes through a system evaporator for heat exchange, the system evaporator being connected to a suction side of the system compressor, the maintenance unit having a recovery expansion valve connected to a recovery evaporator, which leads to a suction side of a recovery compressor, the recovery compressor having an output side connected to a recovery condenser which leads to a storage container which has an outlet conduit, the maintenance unit having at least one filter, the method comprising:

connecting the outlet conduit of the storage container to an inlet side of the recovery expansion valve and placing a control valve in the outlet conduit;

connecting recovery hoses from the suction side and the output side of the system compressor to the recovery expansion valve; then while the control valve is closed, operating the recovery compressor to recover refrigerant through the recovery hoses from the suction side and the output side of the system compressor, and flowing the recovered refrigerant through the recovery expansion valve, recovery evaporator, filter, recovery condenser and into the storage container; then opening the control valve, and operating the recovery compressor to supply refrigerant from the storage container through the outlet conduit and both recovery hoses into the air conditioning system simultaneously on both the suction side and the output side of the system compressor to fill and pressurize the air conditioning system with refrigerant, with some of the refrigerant from the outlet conduit flowing through the recovery expansion valve and recovery evaporator to the recovery compressor; then when the first occurrence of a maximum refrigerant pressure in the air conditioning system or a selected time interval has passed, closing the control valve in the outlet conduit of the storage container, and operating the recovery compressor to recover refrigerant through both recovery hoses from the suction side and the output side of the system compressor and passing the recovered refrigerant through the recovery expansion valve, recovery evaporator, filter, recovery condenser and into the storage container, the recovered refrigerant bringing along with it foreign matter from the air conditioning system which is filtered by the filter.

* * * * *